United States Patent [19]

Silvestri, Jr.

[11] 4,242,041

[45] Dec. 30, 1980

[54] ROTOR COOLING FOR DOUBLE AXIAL FLOW TURBINES

[75] Inventor: George J. Silvestri, Jr., Upper Chichester, Pa.

[73] Assignee: Westinghouse Electric Corp., Pittsburgh, Pa.

[21] Appl. No.: 3,458

[22] Filed: Jan. 15, 1979

Related U.S. Application Data

[62] Division of Ser. No. 806,404, Jun. 14, 1977, Pat. No. 4,150,917.

[51] Int. Cl.[3] ..... F01D 25/00; F01D 11/00

[52] U.S. Cl. ..... 415/115; 415/168

[58] Field of Search ..... 415/115, 121 A, 168, 415/175, 176

[56] References Cited

U.S. PATENT DOCUMENTS

| | | | |
|---|---|---|---|
| 2,467,818 | 4/1949 | Elston | 415/168 |
| 2,905,434 | 9/1959 | Hertl | 416/168 |
| 3,189,320 | 6/1965 | Beldecos et al. | 415/168 |
| 3,206,166 | 9/1965 | Beldecos et al. | 415/168 |
| 3,360,189 | 12/1967 | Cook | 415/168 |
| 3,738,770 | 6/1973 | Bolter | 415/168 |
| 3,751,909 | 8/1973 | Kohler | 415/115 |

FOREIGN PATENT DOCUMENTS

| | | | |
|---|---|---|---|
| 1030357 | 5/1958 | Fed. Rep. of Germany | 415/168 |
| 929103 | 6/1963 | United Kingdom | 415/168 |

*Primary Examiner*—Carlton R. Croyle
*Assistant Examiner*—A. N. Trausch, III
*Attorney, Agent, or Firm*—G. H. Telfer

[57] ABSTRACT

A double axial flow turbine structure having rotor cooling on the upstream side of the turbine's inlet or control stages with lower pressure turbine stages being situated axially downstream from the control stages. Motive fluid flow through the control stages is in opposite axial directions. Apertures in the control stages' rotatable disc portions of the rotor cause motive fluid which has been expanded through the control stages to be pumped into a cooling space formed axially between the control stages and radially between the rotor and a stationary structure which constitutes either one or two nozzle chambers which direct the motive fluid into the control stages. Motive fluid leakage between the stationary structure and the control stage discs is minimized by a first set of seals disposed between each control stage disc and the stationary structure. Motive fluid leakage contact with the rotor is minimized by a second set of seals disposed between each control stage and the stationary structure with a conduit providing fluid communication through the stationary structures for the leakage past the first sets of seals to an area between the stationary structures prior to transmission of such leakage to the exits from the control stages.

4 Claims, 7 Drawing Figures

ROTOR COOLING FOR DOUBLE AXIAL FLOW TURBINES

This is a division of application Ser. No. 806,404, filed June 14, 1977 now U.S. Pat. No. 4,150,917.

BACKGROUND OF THE INVENTION

1. Field of the Invention

This invention relates to single and double axial flow turbines, and more particularly to means for cooling a turbine rotor having axially successive rows of blades which are normally subjectible to axially decreasing motive fluid pressure.

2. Description of the Prior Art

High temperature steam turbines often require cooling for the hot and highly stressed moving components to insure reliable operation at such high temperatures. Thus, many arrangements have previously been proposed for cooling the exposed, hot, rotating turbine components by use of coolant fluids.

A highly effective arrangement for accomplishing such cooling is that described and claimed in the Beldecos and Leyland patent application No. 3,206,166, issued Sept. 14, 1965, and assigned to the assignee of the present invention. In accordance with the Beldecos and Leyland arrangement, an axial flow steam turbine is provided in which the control or first expansion stage includes an annular row of rotor blades carried by a disc portion of the rotatable rotor structure and cooperatively associated with a nozzle vane structure portion of a stationary structure. Sealing means are provided between the disc and nozzle vane structure for minimizing motive fluid leakage therebetween from the desired main motive fluid path as it exits the control stage nozzle vane structure. A second sealing means is also provided between the control stage rotor disc and its associated nozzle were structure spacially separated from the first sealing means and together therewith defining a sealing volume for collecting motive fluid leakage which escaped past the first sealing means. Motive fluid which enters the sealing volume is transmitted therefrom to a downstream turbine stage through a plurality of conduits, parts of which are provided in the stationary structure. A major portion of the motive fluid which has been expanded through the control stage's rotor blades reverses flow direction, sweeps over the exterior of the stationary structure and its connected supply conduit, and enters the turbine's second nozzle vane structure. While a small portion of the remainder of the once-expanded motive fluid escapes axially downstream from the control stage, much of the remainder is pumped through a series of axially directed apertures in the control stage rotor disc. Such pumping action forces the once-expanded and thus cooled motive fluid through the disc into a space between the stationary structure and the rotor in an axial direction which is substantially opposed to that of the main motive fluid path through the control stage. The pumping action provides a sufficient rise in pressure to oppose hotter motive fluid leakage through the second sealing means and causes the relatively cooler, once-expanded motive fluid to blanket the rotor while traversing its way to the second nozzle vane structure.

While the above-described cooling arrangement is highly successful, it is to be noted that the main motive fluid flow path must be axially reversed in passing from the control stage to subsequent and lower pressure expansion stages. Flow reversal of the motive fluid leaving the control stage results in significant thermodynamic losses which adversely affect turbine efficiency. These losses include static pressure reductions and velocity dissipation of the motive fluid during its travel between the control stage and subsequent lower pressure expansion stages. It is therefore desirable to avoid such motive fluid flow reversal and its attendant thermodynamic losses while retaining its rotor cooling characteristics. Avoidance of such flow reversal is desirable for double as well as single axial flow turbines.

SUMMARY OF THE INVENTION

In accordance with the present invention, an improved rotor cooling scheme is provided for maintaining the rotor temperature at an acceptable level while improving the thermodynamic performance of the utilizing turbine apparatus. The invention generally comprises an elastic fluid turbine having a series of axially adjacent motive fluid expansion stages adapted to receive motive fluid flow from preceding, higher pressure stages axially upstream therefrom. The first or control stage includes a stationary structure having an annular nozzle chamber situated adjacent an annular row of nozzle vanes with the nozzle chamber being adapted to distribute the motive fluid to the nozzle vanes for acceleration therethrough. A disc portion of a rotor structure is situated adjacent the stationary structure and has an annular row of blades circumferentially arranged thereon and in proper alignment with the nozzle vanes for reception of motive fluid thereform. Two sealing means are interposed in series flow relationship between the stationary structure and the first disc portion and define therewith a collection volume with the sealing means minimizing motive fluid leakage between the stationary structure and the first disc portion to a cooling space formed between the rotor and the stationary structure.

A conduit formed in the stationary structure provides fluid communication from the collection volume to the second motive fluid expansion stage for motive fluid leakage past the first seal means. Several apertures are provided in the first rotor disc portion for rotatably pumping a portion of the once-expanded and thus cooler motive fluid upstream through the disc portion and into the cooling space from where it may be routed to any suitable destination. An expansion space between adjacent elements of the stationary structure comprises a portion of the conduit and extends to the leakage space. A third sealing means minimizes leakage between the expansion space and the cooling space thus preventing high temperature motive fluid from contacting the rotor.

For turbines having double flow control stages the leakage space surrounds the rotor and extends axially between control stage disc portions. The control stages' disc portions cooperate to supply the pumping action for forcing the one expanded motive fluid through both discs' apertures and the connecting cooling space situated therebetween. When separate nozzle chamber structures are utilized for each control stage, a sealing means is provided between axially adjacent nozzle chambers and prevents motive fluid leakage routed through the stationary structures from entering the cooling space and contacting the rotor.

BRIEF DESCRIPTION OF THE DRAWINGS

The invention will be more fully understood from the following detailed description of a preferred embodiment, taken in connection with the accompanying drawings, in which.

DESCRIPTION OF THE PREFERRED EMBODIMENT

The present invention is concerned primarily with cooling means for elastic fluid turbine rotors. Accordingly, in the description which follows the invention is shown embodied in large axial flow steam turbines. It should be understood, however, that the invention may be utilized as a cooling scheme for the rotor in any elastic fluid turbine.

Figure 1:
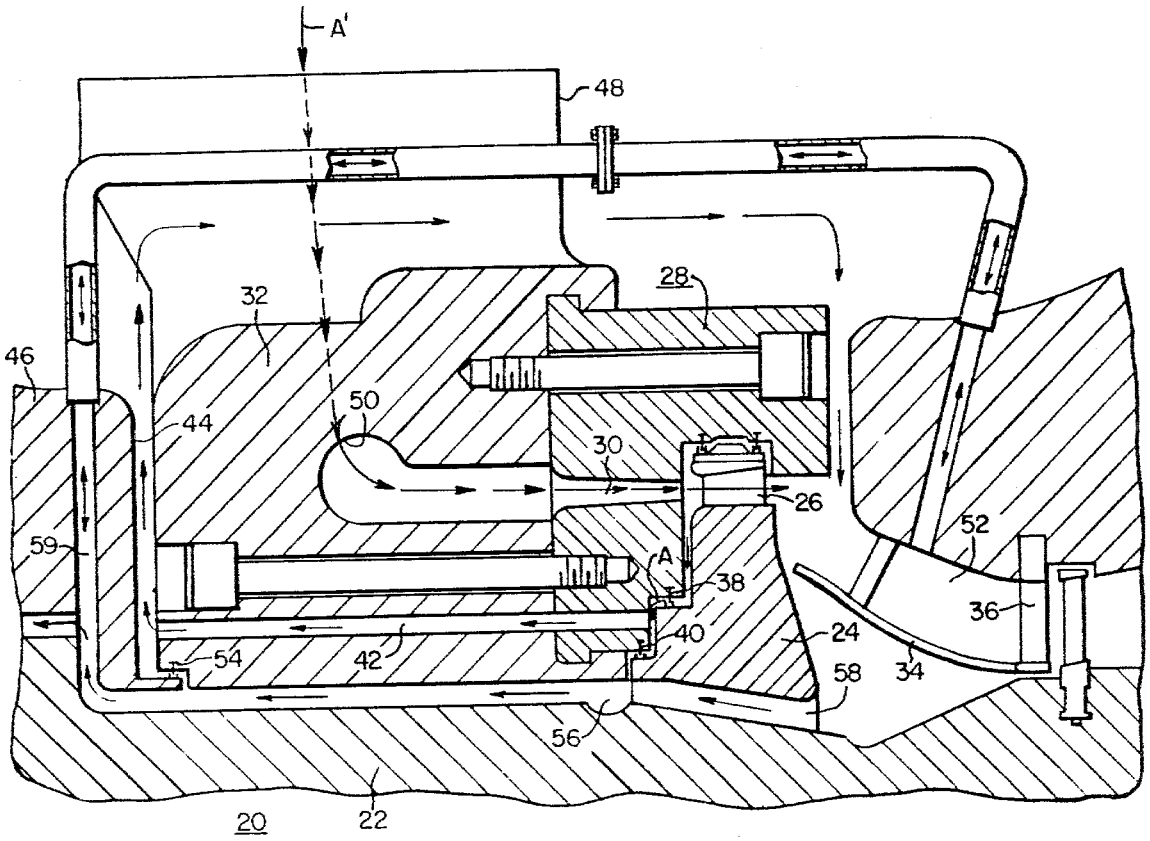
FIG. 1 is a parital transverse sectional view of a single flow control stage exemplary turbine in which the invention is incorporated.

FIG. 1 shows a portion of an axial flow steam turbine generally designated 20 having an axially elongated rotor structure 22 which includes radially protruding rotor disc 24. An annular row of rotor blades 26 is disposed circumferentially on rotor disc 24. Rotor blades 26 are disposed downstream from stationary structure 28 which includes an annular array of nozzle vanes 30 which are cooperatively associated with rotor blades 26 for directing hot motive steam thereto. Stationary structure 28 also includes an annular nozzle chamber structure 32 for guiding the hot motive fluid to the nozzle vanes 30. The control stage blades 26 extract substantial energy from the hot motive steam causing a concomitant pressure drop and temperature reduction across the stage.

After the motive steam has been partially expanded through control stage nozzle vanes 30 and blades 26, a major portion of that motive steam is guided axially downstream from the control stage by flow guide 34 which provides a smooth transition surface between rotor blades 26 and second stage nozzle vanes 36. A minor portion of the hot motive steam leaks between nozzle chamber structure 32 and rotor disc 24 as illustrated by arrow A. Such leakage is highly undesirable since it is comprised of hot steam which has not been expanded through the work producing rotor blades 26 and can adversely affect the life of rotor 22 if it contacts that rotor during high-speed rotation. To minimize such leakage seal strips 38 are disposed in closely spaced relation and are affixed to the nozzle chamber structure 32 and the relatively rotatable control stage disc 24. Sealing strips 40 are also disposed across the gap separating nozzle chamber 32 and disc 24 for further minimizing motive steam leakage to the rotor 22. Steam leakage which escapes past sealing strips 38 is diverted through conduit 42 which is formed in the nozzle chamber structure 32. From conduit 42 the steam leakage travels radially outward through expansion space 44 separating stationary structure 28 from a thrust balancing dummy ring 46 and then turns axially downstream along the inner surface of the turbine's outer casing (not shown). While passing axially downstream, the steam leakage sweeps the exterior of steam inlet conduit 48 which conducts inlet motive steam to a generally toroidal nozzle chamber 50 which, in turn, directs the steam into nozzle vanes 30. The motive steam path from entry into inlet conduit 48 and expansion through rotor blades 26 is indicated by arrows A′ in all Figures. After sweeping the exterior of inlet conduit 48, the steam leakage flows radially inward to the control stage exhaust annulus 52 where it rejoins the main motive steam flow before its expansion through the second stage.

Expansion space 44 separates dummy ring 46 from nozzle chamber structure 32 between their radially inner and radially outer extremities. Seal 54, illustrated as sealing strips, is disposed across expansion space 44 at a position radially inside conduit 42 to prevent motive steam leakage from passing radially inward and contacting rotor 22. Cooling space 56, formed axially upstream from rotor disc 24, is required to separate the relatively rotatable rotor 22 and surrounding stationary structure 28. During rotor 22 rotation, relatively cool, once expanded, motive steam is pumped from exhaust annulus 52 through aperture 58 in rotor disc 24 into cooling space 56 to cool rotor 22 and to resist hot steam intrusion past seals 40 and 54. A portion of the steam pumped through cooling space 56 may also be returned to the main steam flow via conduit 59, by example, for further expansion in subsequent and lower pressure expansion stages. Steam may pass through conduit 59 in either direction to relieve pressure induced thrust variations caused by changing steam demands of balancing ring 46.

Figure 2:
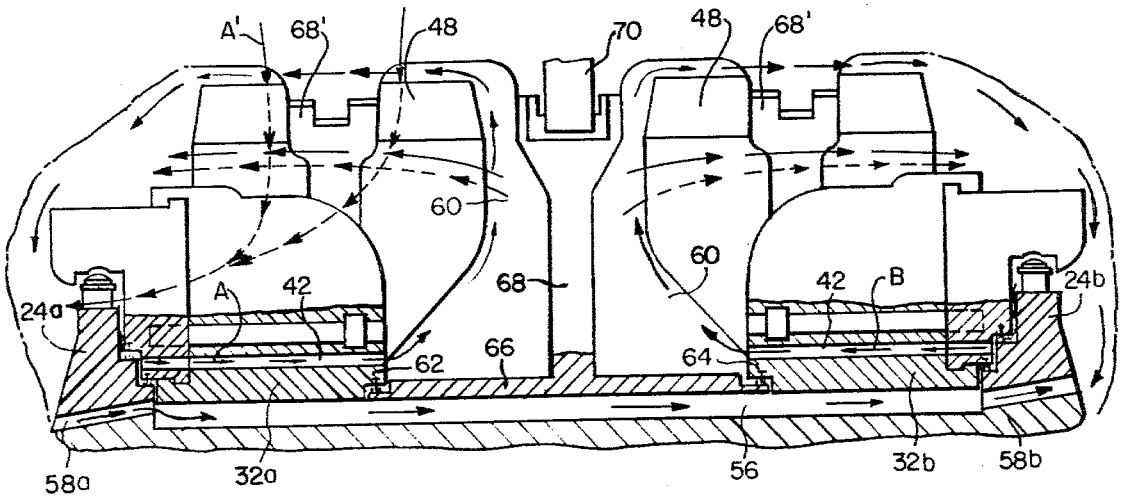
FIG. 2 is a partial transverse sectional view of a double flow control stage exemplary turbine in which the invention is utilized.
Figure 3:
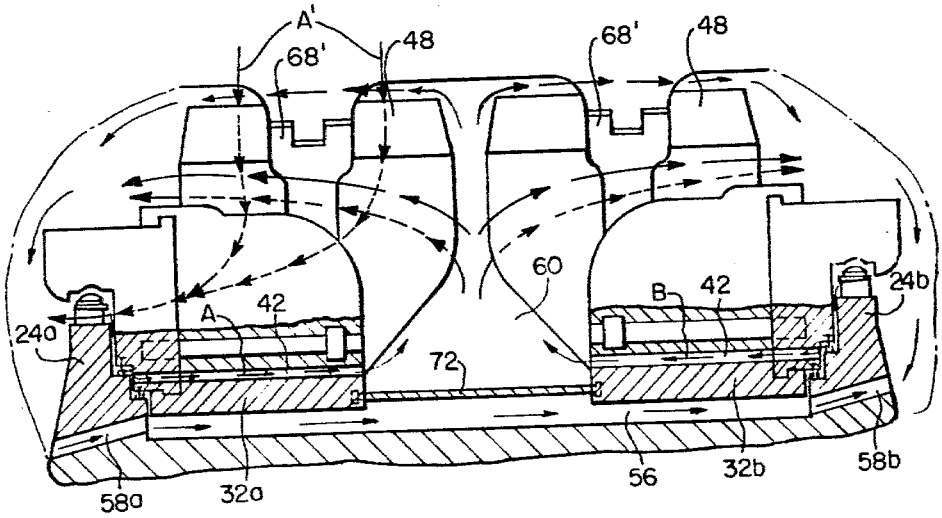
FIG. 3 is a partial transverse sectional view of a double flow control stage exemplary turbine utilizing another embodiment of this invention.

FIGS. 2 and 3 illustrate alternate embodiments of this invention as it is utilized on double flow control stages having separate nozzle chamber structures **32*a* and 32*b*. Conduits 42 through each nozzle chamber structure pass hot steam leakage therethrough as indicated by arrows A and B to a separating space 60 situated axially between the nozzle chamber structures. After passing into the separation space 60, steam leakage is guided axially downstream and sweeps the exterior of inlet conduits 48 which have radial extensions (not shown) connected thereto which pass through the turbine's outer casing. It is to be understood that the steam leakage flow passes on the near and far sides of conduit 48 as respectively indicated by full and phantom arrows. Cooling space 56 for double flow control stages extends axially between the control stages with cool, once expanded steam being forced therethrough in either or both axial directions. The angle of inclination of apertures 58*a* and 58*b* can be selected to provide appropriate axial flow directions while suitable mass flow rates therethrough may be obtained by modifying the size and number of apertures in each rotor disc 24*a* and 24*b*. FIGS. 2 and 3 differ in the way separation space 60 is sealed from cooling space 56 for preventing motive steam flow therebetween. Such alternate sealing or shielding means are hereafter described. FIG. 2 utilizes seals 62 and 64 to minimize leakage between cylindrical plate 66 and each of the nozzle chamber structures 32*a*** and 32*b*. Cylindrical plate 66 is illustrated as being supported by rib 68 at a dowelled spigot 70 located near the radially outer periphery of the turbine structure. Exemplary rib structures 68 are disposed on the nearside of conduits 48 and extend from the turbine's outer casing to the nozzle chamber structures 32*a* and 32*b* to provide support therefor. FIG. 3, however, utilizes a flexible plate member 72 disposed axially between and supported in a fixed, sealing manner at each axial end in nozzle chamber structure 32*a* and 32*b* respectively. Sealing plate 72 provides a positive zero leakage seal and additionally, due to its flexible character, also serves as a flex plate to compliment or replace currently used plates whose purpose is to reduce vibration of the nozzle chamber structures.

Figure 4:
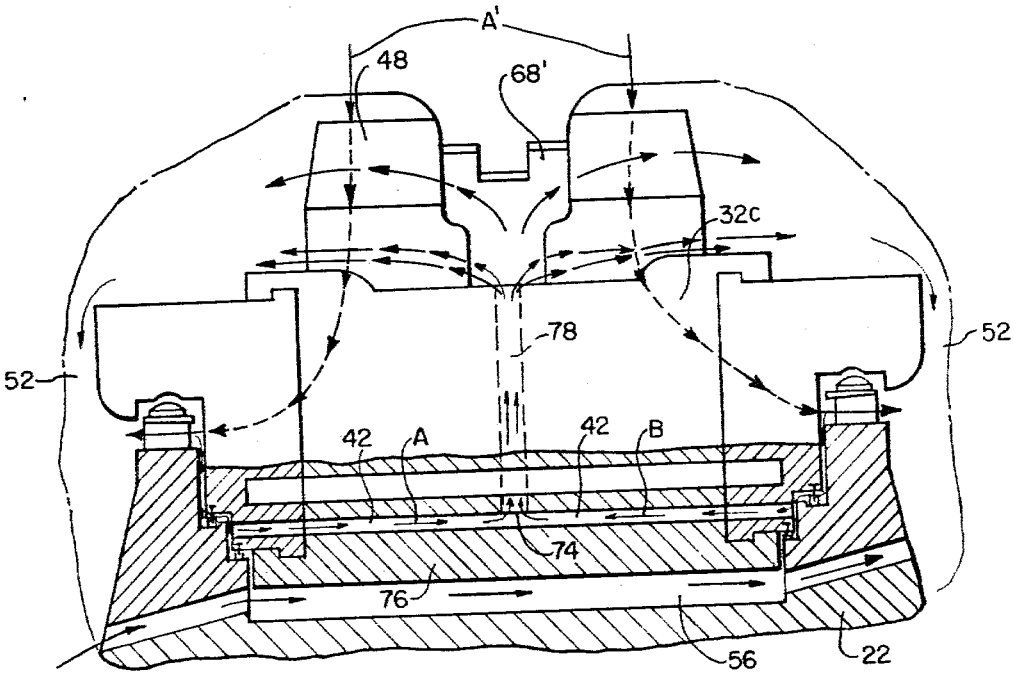
FIG. 4 is a partial transverse sectional view of a double flow control stage exemplary turbine having a single nozzle chamber structure in which the invention is utilized.

FIG. 4 illustrates a partial sectional view of a turbine utilizing double flow control stages which receive steam from a single nozzle chamber structure 32*c*. The configuration illustrated in FIG. 4 can be utilized with either single or double flow downstream stages. To utilize the present invention in the configuration of FIG. 4 it is necessary to form a circumferential collection header slot 74 in the base of the nozzle chamber 32*c*. Cover plate 76 on the radially inner side of header 74 prevents motive steam leakage from entering cooling space 56 and contacting rotor 22. Radial discharge pipe 78 connects collection header 74 with the radially outer surface of nozzle chamber structure 32*c*. Hot steam leakage follows a flow path indicated by arrows A and B while passing through conduits 42 in the base of nozzle chamber structure 32*c*, enters collection header 74, flows circumferentially and axially within collection header 74, flows radially outward through discharge pipe 78 in nozzle chamber structure 32*c*, and exits discharge pipe 78 before sweeping the exterior of steam inlet conduit 48 and joining the main steam flow at either or both control stage exhaust annuli 52. Rib structure 68 is, by example, disposed on the near side of inlet conduit 48 and extends between the turbine's outer casing and nozzle chamber structure 32*c*. While this steam leakage collection system is substantially different from earlier Figures, the rotor cooling scheme of FIG. 4 is essentially the same as that shown in FIGS. 2 and 3.

Figure 5A:
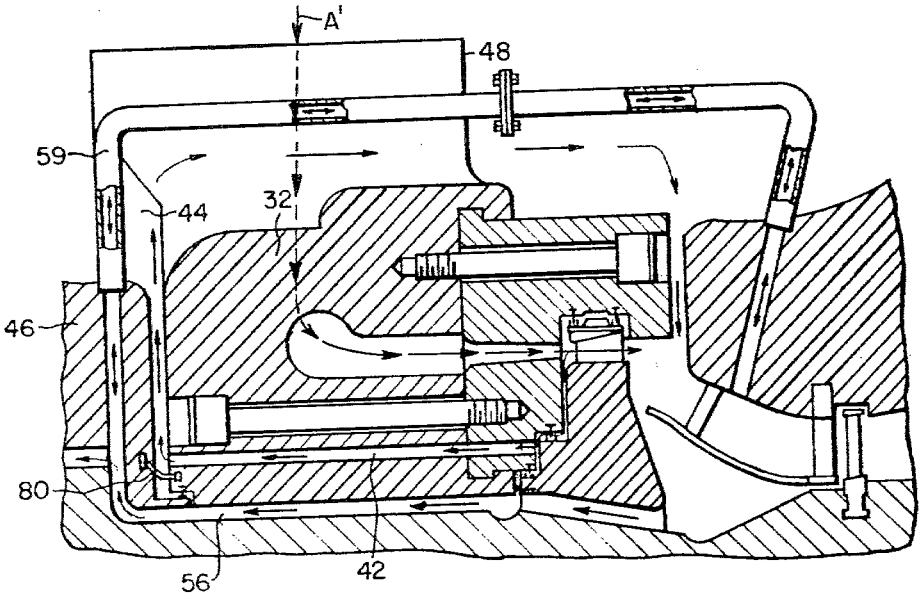
FIGS. 5A and 5B are partial transverse sectional views of a single flow control stage illustrating leakage deflectors for the bottom and top halves of the turbine respectively.
Figure 5B:
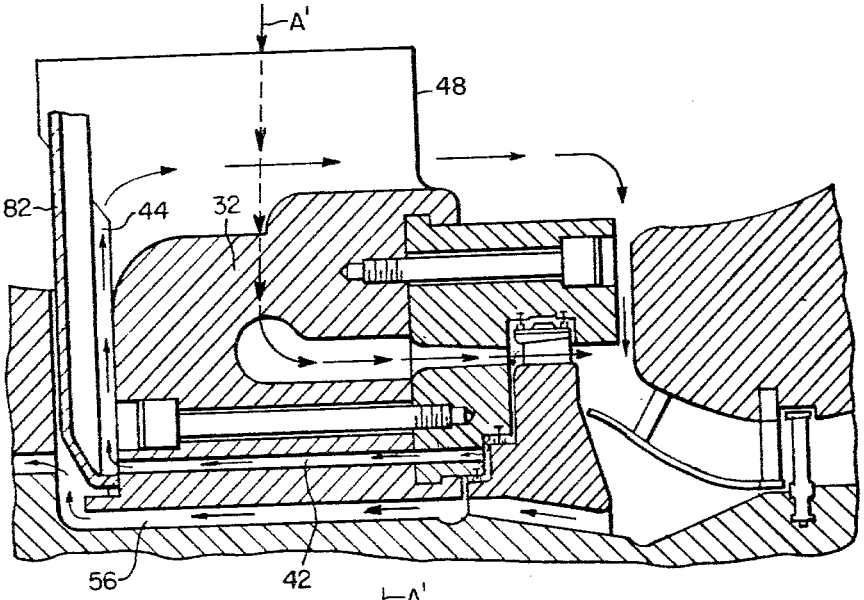

FIGS. 5A and 5B illustrate a sealing scheme which is an alternative to seal 54 in FIG. 1. FIG. 5A shows a leakage deflector plate 80 disposed in expansion space 44 between dummy ring 46 and nozzle chamber structure 32. FIG. 5B illustrates a similar leakage deflector plate 82 also disposed in the expansion space 44 but attached only to nozzle chamber structure 32. Deflector plate 80 in FIG. 5A is to be utilized in the lower one-half of a horizontally jointed turbine while the deflector plate 82 of FIG. 5B is to be utilized in the upper, mating half of the turbine. Although deflector plate 80 isolates the entire expansion space 44 from cooling space 56, deflector plate 82 isolates only a portion of expansion space 44 and guides the motive steam leakage from conduit 42 through that isolated portion. Conduit 59, illustrated in FIG. 5A, can be used to provide pressure equalization as previously disclosed in the discussion for FIG. 1.

Figure 6:
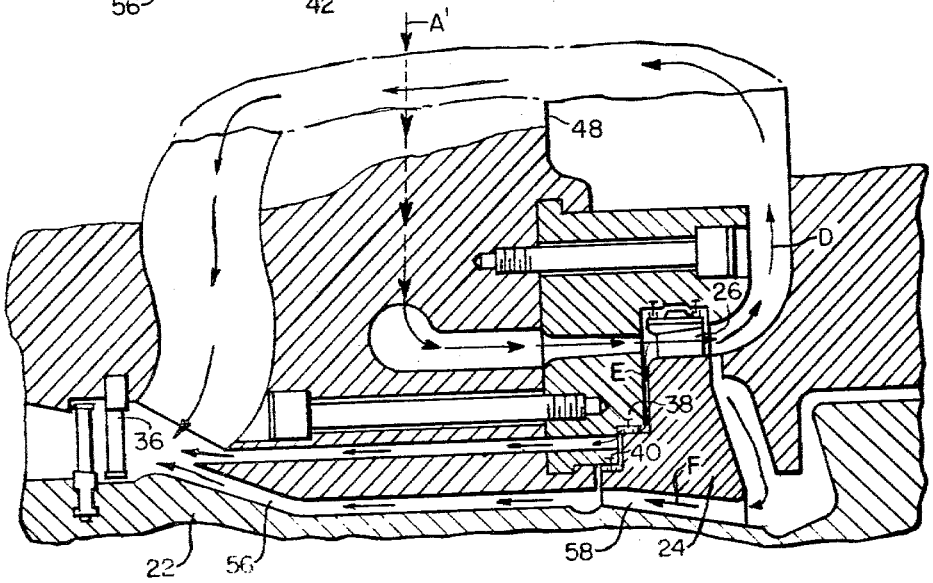
FIG.6. PRIOR ART
FIG. 6 is a partial transverse sectional view of a prior art single flow control stage turbine.

FIG. 6 illustrates a prior art turbine utilizing rotor and the inlet steam conduit cooling by reversing the main steam flow exhausting from rotatable control stage blades 26. The reversed main steam flow path is indicated by arrows D. Motive steam leakage past seal 38 and through conduit 42 is indicated by arrow E while the flow path of the relatively cool, once expanded motive steam pumped through aperture 58 and cooling space 56 is exemplified by arrows F. Steam flows D, E, and F are mixed together in an annular space immediately upstream from nozzle vanes 36 of a second motive fluid expansion stage.

Although not shown, it is to be understood that the double flow control stages may pump steam in opposite directions toward each other through cooling space 56 to a common header for transmission to the downstream stages of one or both control stages. It is to be further understood that double flow control stage discs having single flow downstream stages such as the structure illustrated in FIG. 4, can also pump the cooling steam through cooling space 56 in opposite directions for collection and distribution to the single flow downstream stages.

The thermodynamic performance of an axial flow turbine utilizing the present invention's non-reversing steam flow is greatly improved with additional benefits accruing in reduced material and manufacturing costs due to the smaller required rotor and housing length. Such reduced space requirements for the turbine provide large cost savings not only in material and labor but also in building and foundation costs for the turbine in central station applications.

It will now be apparent that an improved elastic fluid turbine has been provided which increases the efficiency thereof while retaining the prior art's reliability assurance feature of rotor cooling. Judicious selection of steam leakage paths and steam cooling paths enabling utilizing turbines to operate at higher efficiency with simpler construction and greater reliability.

I claim:

1. An elastic fluid turbine apparatus comprising:

a first and a second motive fluid expansion stage, said first and second stages respectively including first and second stationary structures, said first and second stationary structures respectively having first and second annular nozzle chamber structures, said stages being arranged in axially opposed parallel flow relation with each other;

a rotor structure having first and second disc portions respectively disposed adjacent said first and second stationary structures, said first and second disc portions each having an annular row of blades circumferentially disposed thereon and cooperatively associated with the respective first and second nozzle chamber structures, said disc portions each having an axially upstream side adjacent said associated nozzle chamber structure and an axially downstream side remotely disposed relative to said associated nozzle chamber structure, said rotor also having a reduced diameter portion extending axially between said disc portions;

said stationary structures, being annular in shape, are disposed in closely spaced encompassing relation with said reduced diameter rotor portion and jointly therewith define a cooling leakage space;

said first and second disc portions each having at least one aperture therein for pumping a portion of the once expanded motive fluid through both of said discs and the connecting cooling space;

first sealing means for minimizing leakage of motive fluid between said cooperating nozzle chamber structures and discs;

second sealing means for minimizing motive fluid leakage from said first sealing means into said cooling space; and means for guiding said motive fluid leakage from said first sealing means to the downstream side of said first and second disc portions, said guiding means including a plurality of openings axially extending through said nozzle chamber structures from adjacent the upstream side of the disc portions to between said stationary structures.

2. The elastic fluid turbine apparatus of claim 1, said stationary structure further comprising:

shielding means for protecting said reduced diameter rotor portion by minimizing ingress of said motive fluid leakage into said cooling space from between said nozzle chamber structures.

3. The elastic fluid turbine apparatus of claim 2, said shielding means comprising:

a seal plate axially disposed between said nozzle chamber structures, said seal plate being fixedly attached to said nozzle chamber structures.

4. The elastic fluid turbine apparatus of claim 2, said shielding means comprising:

a seal plate axially disposed between said nozzle chamber structures in closely spaced relation therewith and third sealing means interposed between said nozzle chamber structures and said plate.

* * * * *